US009082389B2

(12) United States Patent
Nicholson et al.

(10) Patent No.: US 9,082,389 B2
(45) Date of Patent: Jul. 14, 2015

(54) PRE-SHAPING SERIES FILTER FOR ACTIVE NOISE CANCELLATION ADAPTIVE FILTER

(71) Applicant: Apple Inc., Cupertino, CA (US)

(72) Inventors: Guy C. Nicholson, Cupertino, CA (US); Thomas M. Jensen, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 470 days.

(21) Appl. No.: 13/629,279

(22) Filed: Sep. 27, 2012

(65) Prior Publication Data

US 2013/0259250 A1 Oct. 3, 2013

Related U.S. Application Data

(60) Provisional application No. 61/618,432, filed on Mar. 30, 2012.

(51) Int. Cl.
*G10K 11/16* (2006.01)
*G10K 11/178* (2006.01)

(52) U.S. Cl.
CPC ..... *G10K 11/1782* (2013.01); *G10K 11/178* (2013.01); *G10K 2210/1081* (2013.01); *G10K 2210/3028* (2013.01)

(58) Field of Classification Search
CPC ..... H04R 2227/005; H04R 25/356; H04R 27/00; H04R 3/002; H04R 3/04; H04R 1/02; H04R 3/00
USPC ..... 381/71.1–71.8, 71.11–71.14, 92, 381/94.1–94.7; 700/94; 704/233
See application file for complete search history.

(56) References Cited

U.S. PATENT DOCUMENTS

| | | | | |
|---|---|---|---|---|
| 5,937,070 | A * | 8/1999 | Todter et al. | 381/71.6 |
| 6,396,930 | B1 | 5/2002 | Vaudrey et al. | |
| 8,538,749 | B2 | 9/2013 | Visser et al. | |
| 8,831,936 | B2 | 9/2014 | Toman et al. | |
| 2009/0299742 | A1 * | 12/2009 | Toman et al. | 704/233 |

(Continued)

FOREIGN PATENT DOCUMENTS

| | | | |
|---|---|---|---|
| EP | 0 579 152 | A1 | 1/1994 |
| EP | 1 074 971 | A2 | 2/2001 |
| JP | 6067681 | A | 3/1994 |

(Continued)

OTHER PUBLICATIONS

TW Office Action (dated Nov. 3, 2014), ROC (Taiwan) Patent Application No. 102111577, Date Filed—Mar. 29, 2013, (4 pages).

(Continued)

*Primary Examiner* — Lun-See Lao
(74) *Attorney, Agent, or Firm* — Blakely, Sokoloff, Taylor & Zafman LLP

(57) ABSTRACT

A feed forward active noise cancellation (ANC) system for use in a portable audio device has an adaptive digital filter and a reference microphone. A non-adaptive pre-shaping digital filter has an input coupled to the reference microphone and is in series with, and in front of, the adaptive filter. The pre-shaping filter is minimum phase and presents at least 2 dB more gain over a low audio frequency band than over a high audio frequency band. This may help compensate for low frequency band difficulties, and may thereby extend ANC bandwidth at the low end without a worsening impact on the high end. Other embodiments are also described and claimed.

22 Claims, 6 Drawing Sheets

(56) References Cited

U.S. PATENT DOCUMENTS

| | | | | |
|---|---|---|---|---|
| 2011/0142247 | A1* | 6/2011 | Fellers et al. | 381/71.1 |
| 2011/0299695 | A1* | 12/2011 | Nicholson | 381/71.6 |

FOREIGN PATENT DOCUMENTS

| | | | |
|---|---|---|---|
| KR | 20020061806 | | 7/2002 |
| TW | 201013640 | A | 4/2010 |
| TW | 201015541 | A | 4/2010 |

OTHER PUBLICATIONS

TW Search Report (dated Oct. 29, 2014), ROC (Taiwan) Patent Application No. 102111577, Date Filed—Mar. 29, 2013, (1 page).

PCT International Search Report and Written Opinion, for corresponding International Application No. PCT/US2013/034108, mailing date Jul. 4, 2013, 10 pages.

Kuo, Sen M., et al., "Active Noise Control: A Tutorial Review", Publication Title Proceedings of the IEEE, Posted Online Aug. 6, 2002, vol. 87, Issue 6, (pp. 943-973).

Pfann, Eugen, et al., "LMS Adaptive Filtering with σΔ Modulated Input Signals", IEEE Signal Processing Letters, vol. 5, No. 4, Apr. 1998, (pp. 95-97).

Sun, Xu, et al., "Active Narrowband Noise Control Systems Using Cascading Adaptive Filters", IEEE Transactions on Audio, Speech, and Language Processing, vol. 15, No. 2, Feb. 2007, (pp. 586-592).

Veloso, Alex J., et al., "Headphone with Active Noise Control Using Analog Adaptive Filters", Inter-Noise, Environmental Noise Control, Rio 2005, The 2005 Congress and Exposition on Noise Control Engineering, Aug. 7-10, 2005, Rio de Janeiro, Brazil, (8 pages).

PCT International Preliminary Report on Patentability (dated Oct. 9, 2014), International Application No. PCT/US2013/034108, International Filing Date—Mar. 27, 2013, (8 pages).

* cited by examiner

PRE-SHAPING SERIES FILTER FOR ACTIVE NOISE CANCELLATION ADAPTIVE FILTER

RELATED MATTERS

This application claims the benefit of the earlier filing date of provisional application No. 61/618,432, filed Mar. 30, 2012.

FIELD

An embodiment of the invention is related to active noise cancellation processes or circuits found in portable audio devices such as a smartphone. Other embodiments are also described.

BACKGROUND

Mobile phones enable their users to conduct conversations in different acoustic environments, some of which are relatively quiet, while others are quite noisy. To improve intelligibility of the far-end user's speech to the near-end user who is in a hostile acoustic environment, that is an environment in which the ambient acoustic noise or unwanted sound surrounding the mobile phone (also referred to here as background sound or background noise) is particularly high, such as on a busy street or near an airport or train station, an audio signal processing technique known as active noise cancellation (ANC) can be implemented in the mobile phone. A goal of ANC is to cancel or at least reduce the background sound that is heard by the near end user, for example, through his ear, which is pressed against an earpiece of a handset or is carrying an earphone, by producing an anti-noise signal that is designed to cancel (acoustically) the background sound. Typically, the anti-noise signal is driven through an earpiece speaker that is being used to produce the desired audio. The ANC circuitry uses a microphone referred to as the "error microphone" that is placed inside a cavity that is formed between the user's ear and the inside of an earpiece shell. The error microphone picks up the background sound that has leaked into the cavity, in addition to the desired sound being emitted from the earpiece speaker. In addition, a reference microphone is typically placed on an exterior of the earpiece shell, in order to directly detect the background sound. An adaptive digital filter W is then used to estimate the unknown acoustic response between the reference microphone and the error microphone, so that the output of the adaptive filter W generates an anti-noise signal that is intended to cancel the background sound being heard by the user (and as picked up by the error microphone). An adaptive digital filter controller uses as input the signal from the reference microphone, as well as a representation of the acoustically combined anti-noise and background sound picked up by the error microphone, in order to adapt the filter W over time (e.g., during a phone call or other audio playback session) so that the "error" between the anti-noise and the background sound, as picked up by the error microphone, is reduced as much as possible.

Audio signal processing integrated circuits that can be used to implement the adaptive filter W and the adaptive filter controller have been developed. In such systems, the adaptive filter W has been implemented as a finite impulse response (FIR) digital filter having 128 taps, and an effective sampling rate of about 48 kHz (for sampling the output of the reference microphone).

SUMMARY

The inventors here have determined that the results of an ANC process, in terms of improved quality of noise reduction perceived by a user of a portable audio device in which the ANC process is running, may be improved by properly configuring a pre-shaping filter (also referred to as a biasing or tweak filter, T) that is placed in series with and in front of the reference microphone input of the adaptive filter W. The pre-shaping filter T may be particularly effective in situations where the adaptive filter W does not have sufficient frequency precision to produce the needed anti-noise signal for reducing noise in an audio frequency band below about 375 Hz. The lack of precision of the constrained adaptive filter W below 400 Hz coupled with a roll off in the response of an earpiece speaker below 250 Hz, presents a problem for the effectiveness of the ANC process in low frequency bands. Accordingly, there is a need for an ANC system that has sufficient low frequency resolution so as to produce a reasonably effective anti-noise signal below 400 Hz, while being able to meet other constraints including limited FIR filter size for the adaptive filter W.

In accordance with an embodiment of the invention, ANC circuitry is enhanced by the addition of a non-adaptive digital pre-shaping filter T whose input is coupled to the sampled output of the reference microphone, and where the filter T is in series with and in front of the adaptive digital filter W. The filter W is to be adjusted by an adaptive filter controller based on input from a desired audio signal, the reference microphone, and the error microphone, while it generates an anti-noise signal that is input to the earpiece speaker in order to control the background sound that is heard by a user of the portable audio device. The filter T is configured to be minimum phase and to present at least two dB more gain over a low audio frequency band than over a high audio frequency band. In one embodiment, the extra gain is constrained to between 2 dB-15 dB, and more particularly between 2 dB-10 dB.

In one embodiment, the filter T presents more gain over the low frequency audio band being about 10 Hz-100 Hz, than over the high frequency audio band being about 300 Hz-5 kHz. In another embodiment, the constrained gain increase of 2 dB-15 dB or 2 dB-10 dB is in a low frequency band from about 10 Hz to 250 Hz, relative to a high frequency band from about 1 kHz to 4 kHz.

In addition, the phase response of the filter T over the 10 Hz-5 kHz band exhibits a phase change of less than 90°, and also, in one embodiment, less than 45°. The filter T may be implemented as, for example, a second order, minimum phase filter, e.g. using a conventional bi-quad digital filter structure. Alternatively, where there may be certain restrictions on the filter coefficients for configuring the bi-quad, the filter T may be implemented as a series or cascade connection of at least two first order filters whose coefficients have absolute values that are less than one, and both being minimum phase, where one of which is a low frequency shelving filter and the other is a high frequency shelving filter.

Simulation results show that the pre-shaping filter T extends the effective audio bandwidth of the ANC process at the low end, without worsening the characteristics at the high end. The filter T may be viewed as "biasing" the ANC process, so that, in a magnitude sense, it has a component that counteracts the roll off of the speaker, by for example exhibiting a gain boost or positive gain in the low audio frequency band, e.g. 10 Hz-100 Hz. At the same time, the filter T introduces as little phase change (delay) as possible in the signal processing path from the reference microphone to the speaker and then on to the user's ear (or the error microphone). This path is close to being non-causal due to the short physical distance between the reference microphone and the user's ear, and hence may not tolerate a long delay in producing the anti-noise.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
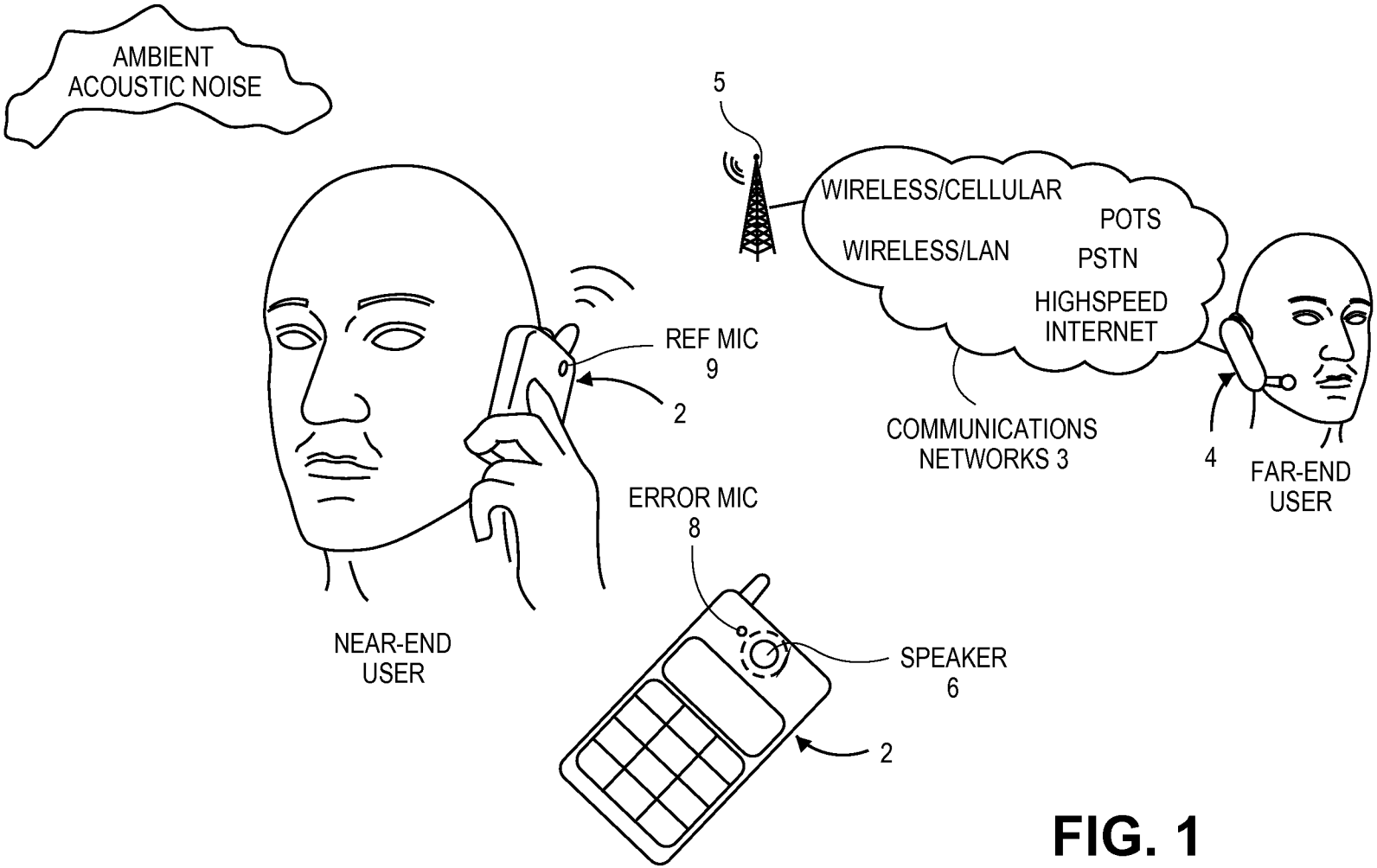
FIG. 1 depicts a mobile communications device in use by a user in a hostile acoustic environment.

FIG. 1 depicts a portable audio device 2, here a mobile communications device, in use by a near-end user in a hostile acoustic environment. The near-end user is holding the portable audio device 2, and in particular an earpiece speaker 6, against his ear, while conducting a conversation with a far-end user. The conversation occurs generally in what is referred to as a call, between the near-end user's device 2 and the far end user's device 4 (being in this example a wireless headset). The call or communications connection or channel in this case, includes a wireless segment in which a base station 5 communicates using, for instance, a cellular telephone protocol, with the near end user's device 2. In general, the ANC circuitry and processes described here are applicable to other types of portable devices such as handheld, battery-powered audio devices, and wired and wireless headsets. These audio devices may be used for two-way live or real-time communication over various known types of networks 3, including wireless cellular and wireless local area network, and those in conjunction with plain old telephone system (POTS), public switch telephone network (PSTN), and perhaps one or more segments over high speed Internet connections (e.g., using voice over Internet protocol). As a further alternative, the ANC circuitry described here may be useful during a one-way audio session where, for instance, the near-end user is listening to music or watching a movie being played back by the audio device 2.

During a call or music playback, the near-end user may hear some of the background sound that surrounds him, where such noise may leak into the cavity that has been created between the user's ear and the shell or housing behind which the earpiece speaker or earphone 6 is located. In this monaural arrangement, the near-end user may be able to hear the speech of the far-end user in his left ear, as shown in the drawing, but in addition may also hear some of the background sound that has leaked into the cavity next to his left ear. The near-end user's right ear in this case is completely exposed to the background sound.

As explained above, an ANC process operating within the audio device 2 may reduce the unwanted sound that reaches the user's left ear and that would otherwise corrupt the primary audio content (e.g., the speech of the far-end user during a call). The performance of the ANC process, in terms of its ability to suppress the unwanted noise that can be heard by the user, should be adequate in both a low audio frequency band, as well as in a high audio frequency band. In some instances, ANC induces audible artifacts that can be heard by the user, particularly in the higher audio frequency band. Also, the performance of ANC may not be sufficient in a low frequency band, as explained above in the Summary Section, due to perhaps insufficient precision by the adaptive filter W. The difficulty in tuning the ANC process in the context of a portable audio device 2 is that the physical distance between a reference microphone 9 and the error microphone 8 is relatively short, such that there is very little time for the digital signal processing imparted by the filter W to produce the needed correction (anti-noise) that will be able to destructively interfere with the leaked background noise just outside the user's ear.

Figure 2:
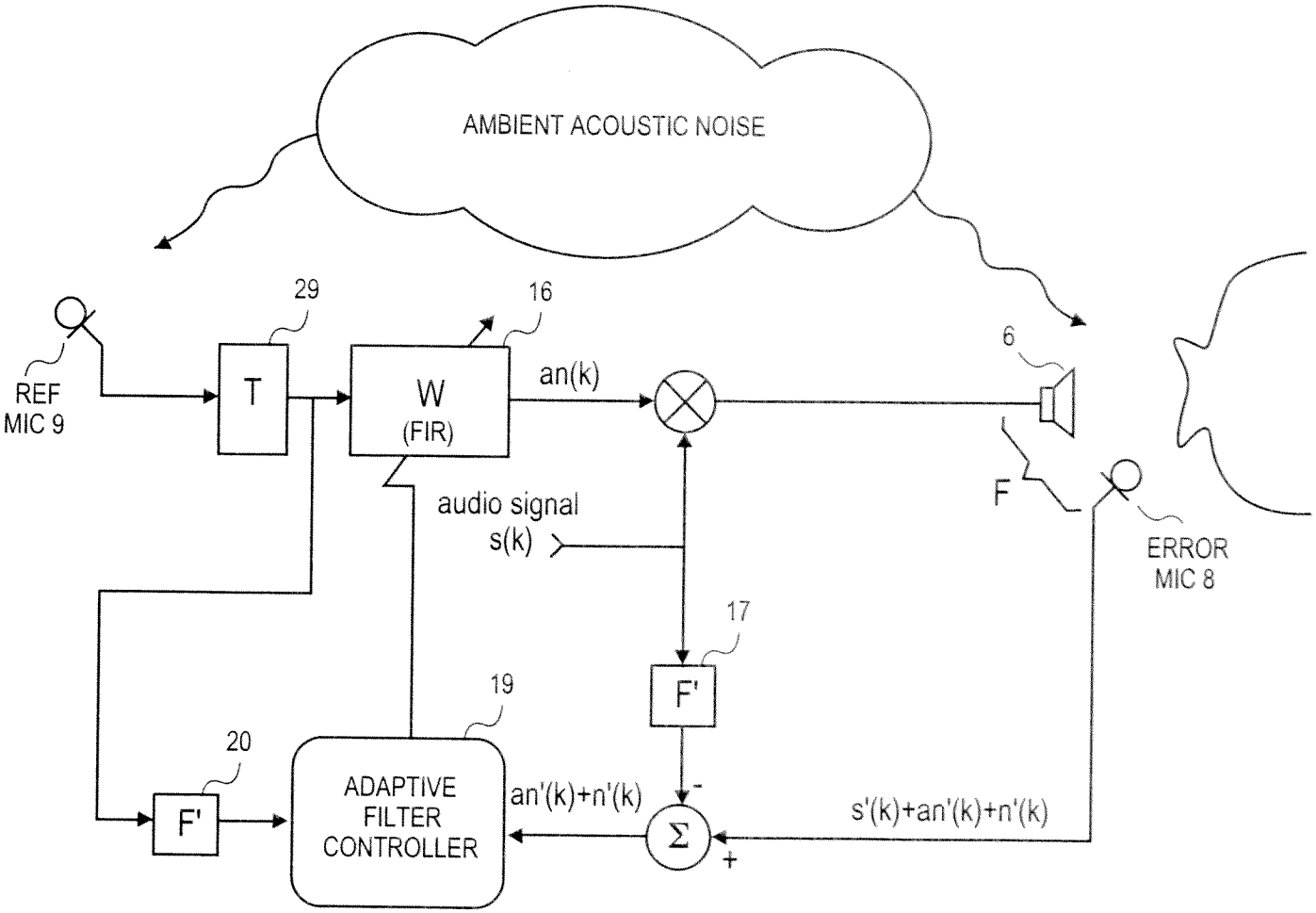
FIG. 2 is a block diagram of part of a portable audio device, including components that are relevant to an active noise cancellation process.

Turning now to FIG. 2, a block diagram of part of the portable device 2 is shown, including constituent components that are relevant to an improved ANC process that is running in the device. As introduced above, the portable device 2 includes a speaker 6 and positioned close to the speaker 6 is the error microphone 8. The error microphone 8 picks up the sound just outside the user's ear, which sound includes contributions from an audio signal s(k), the anti-noise signal an(k), and the background acoustic noise n(k). The symbols represent time sequences of discrete values, as the signal processing operations performed on any audio signals by the blocks depicted in FIG. 2 are in the discrete time domain. More generally, it is possible to implement some of these functional unit blocks in analog form (continuous time domain). In addition, some of the digital signal processing may involve transforming or coding of a discrete time sequence into frequency domain or other sub-band coding representation.

The combination of the speaker 6 and the error microphone 8 along with the acoustic cavity formed against the user's ear is referred to here as the plant F. The frequency response of this unknown system, including magnitude and phase responses, may be estimated by an off-line process (not shown) or by an on-line process, and is labeled transfer function F'. A digital filter that models the system or plant F is described as having such frequency response F'. An instance of this appears as filter 17 which provides an estimate of the primary or desired audio signal s'(k) as it would be picked up by the error microphone. Note that in certain embodiments, such as a smartphone or a satellite-based mobile phone, the plant F varies substantially depending on how and whether or not the user is holding the portable audio device, in particular the earpiece region, against his ear. Accordingly, a fixed model for the transfer function F' may not work in the ANC process, such that the transfer function F' may need to be updated continuously during operation of the ANC process. Conventional techniques may be used to perform such updating of F', including adaptive filter techniques.

The process depicted in FIG. 2 also uses a reference microphone 9 that may also be integrated in a housing of the audio device 2. It should be located and oriented so as to pickup primarily the background acoustic noise and not so much the speech of the near-end user (talker) or any sounds that may be emitted from the speaker 6. As shown in FIG. 1, in the case of a smartphone, the reference microphone 9 may be located on the back face of the smartphone housing oriented outwards; as an alternative, it may be located on a side of the housing. The reference microphone 9 may be different than the talker microphone 9, depicted in FIG. 1 as being located towards the bottom of the handset housing.

The ANC circuitry depicted in FIG. 2 also includes the filter W (filter 16), which is labeled in this example as being an FIR filter, e.g. one having between 1 and fs/f0 taps, where fs is the sampling frequency and f0 is the lowest frequency of interest for effective ANC control. Its output produces the anti-noise signal an(k), based on its input being coupled to the reference microphone 9, through a series connected pre-shaping filter T (filter 29). While the filter W is adaptive, in that its coefficients can be repeatedly and continuously updated during a call by an adaptive filter controller 19, this is not needed for the filter T, which may be non-adaptive. The adaptive filter controller 19 may be in accordance with conventional techniques, executing for example a least (smallest) mean squared error estimate (LMS) algorithm, to find the coefficients of filter W that minimize an error in the destructive acoustic interference produced at the user's ear. Input to such an algorithm may include the output signal of the reference microphone 9 after having passed through the pre-shaping filter T (filter 29) and an instance of the transfer function F' (filter 20), and an estimate of the error given by the difference between the output of the error microphone 8 and an estimate of the audio signal (through filter 17). The adaptive filter controller 19 thus attempts to find the needed coefficients of the filter W that result in the smallest error, for example the sum an'(k)+n'(k).

To help extend the low audio frequency band performance of a feedforward ANC process, such as the one depicted in FIG. 2, and particularly where the filter W has constraints in the number of taps of its FIR structure, a pre-shaping filter T is added in series (receiving the output of the reference microphone 9) and providing its output to the input of the filter W. The adaptive filter controller 19 may also use the output of the pre-shaping filter T as shown, where the pre-shaped signal then passes through an instance of the transfer function F' (filter 20).

Figure 3:
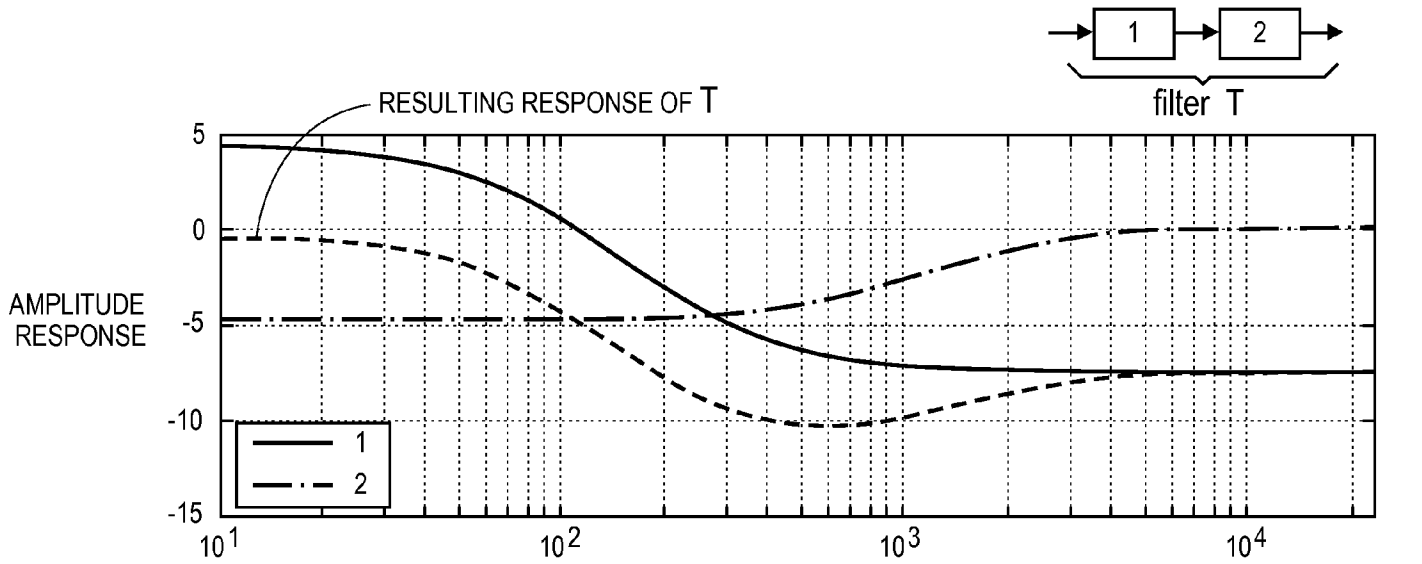
FIG. 3 is a plot of magnitude response for an example non-adaptive filter T, and magnitude responses of its constituent components.

One embodiment of the filter T may include a low shelf, or low frequency shelf, referred to as filter 1, that provides positive gain in a low frequency band. The frequency response of one such filter, as an example, is depicted in the amplitude/magnitude response of FIG. 3, and in the phase response of FIG. 4. For instance, in FIG. 3, filter 1 has a gain in the low frequency band of about 4-5 dB but the gain drops to less than −5 dB above 300 Hz. The filter 1 may be a first order low shelf with positive gain (in the low frequency band). A pole-zero plot of filter 1 is depicted in FIG. 5. The filter 1 has a first order gradient as shown and may be implemented by a one-sample delay digital filter structure. For instance, a bi-quad may be configured into such a first order structure by appropriately setting the second order coefficients to zero. The first order coefficients should be selected so that the filter also exhibits minimum phase. In this case, referring now to the pole zero plot in FIG. 5, the poles of the filter 1 are purely real. In addition, the coefficients of the filter 1 may be restricted to lie between +1 and −1, thereby making good use of existing digital filter blocks.

Figure 6:
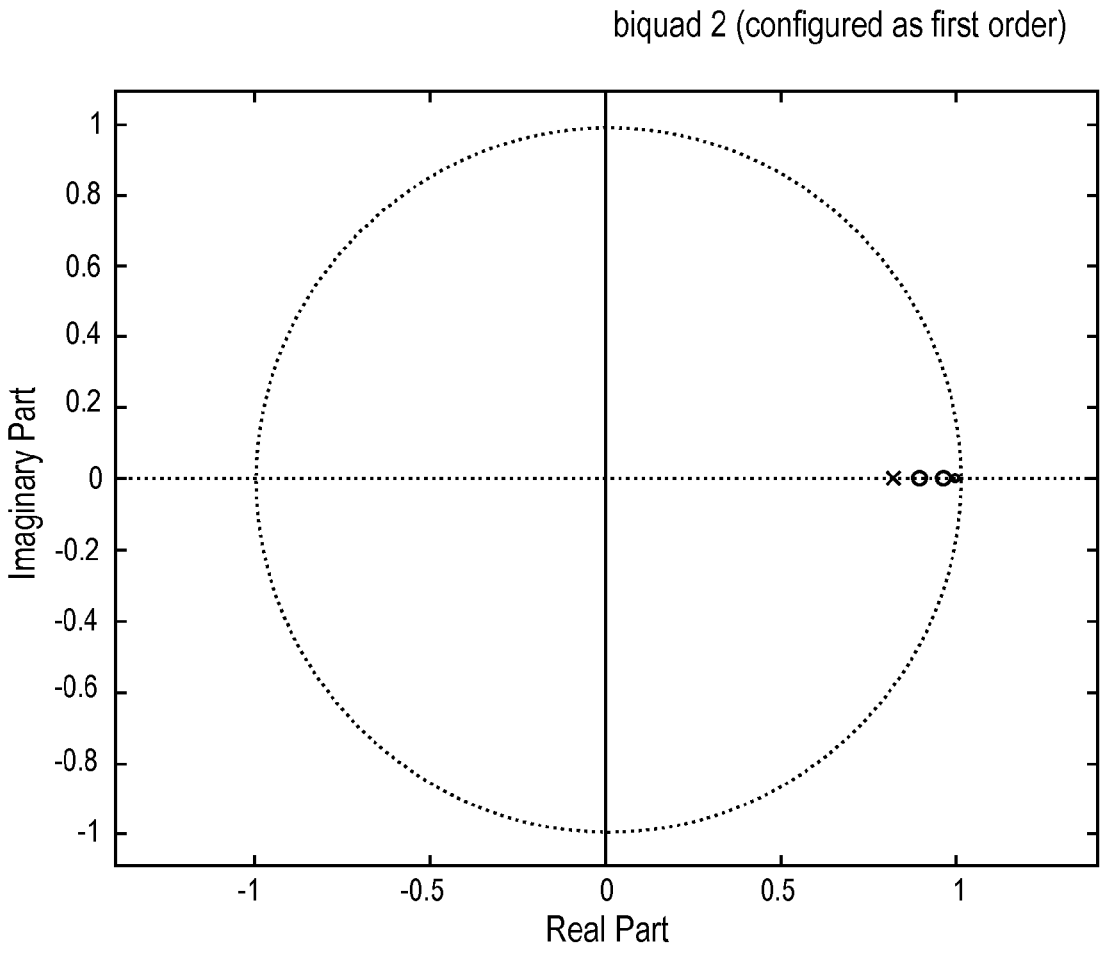
FIG. 6 is a pole zero plot of another first order filter that may be a constituent component of the filter T.

The filter T may also include a second stage, filter 2, which is in series with filter 1. This may be a high shelf, or high frequency shelf, that provides more gain in a high frequency band that in a low frequency band. This is depicted in the magnitude response of FIG. 3, where the gain of filter 2 drops by 5 dB from 3 kHz to 200 Hz. A pole-zero plot for filter 2 is shown in FIG. 6 where it can be seen that the poles are also purely real in this case.

Figure 4:
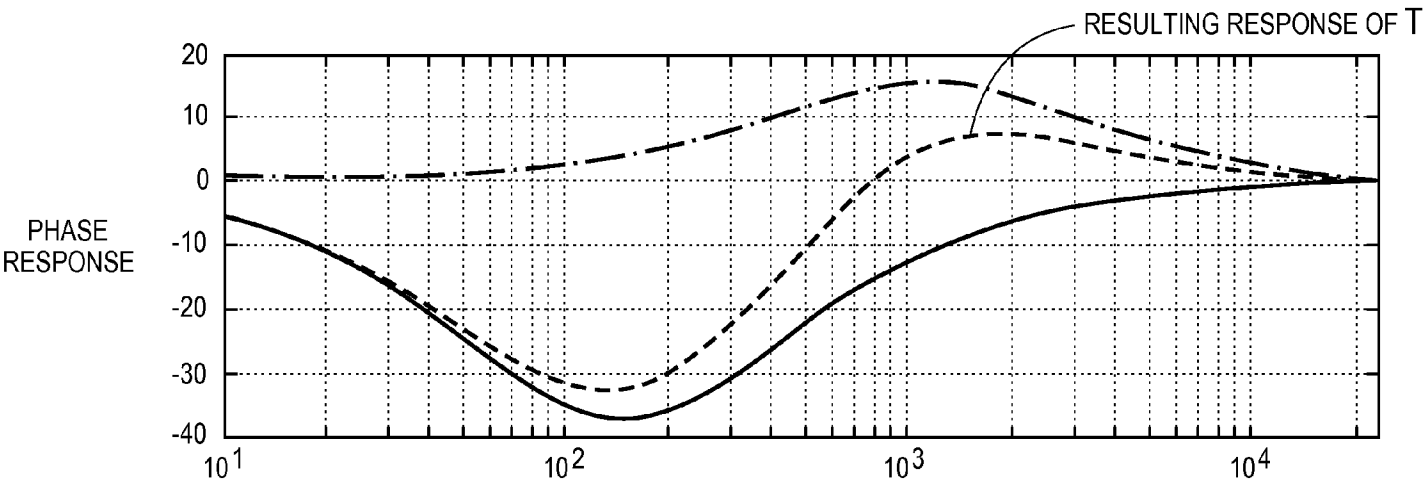
FIG. 4 is a plot of the phase response of the filter T, in the example of FIG. 3.
Figure 5:
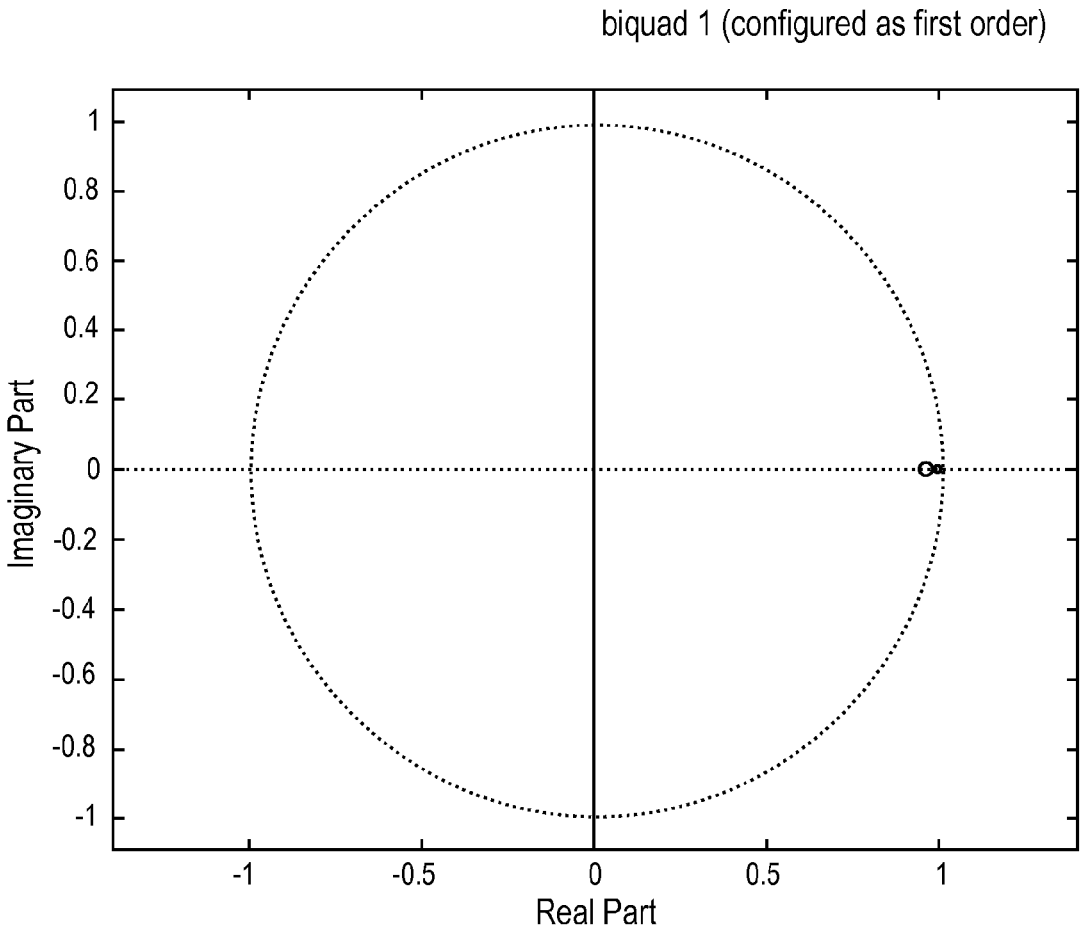
FIG. 5 is a pole zero plot of a first order filter that may be a constituent component of the filter T.

As to the phase responses depicted in FIG. 4, these also have first order gradients of less than 90°, and in particular less than 45°, for the entire audio band from 10 Hz to over 5 kHz. The two filters 1, 2 are therefore considered to be fairly short delay or minimum phase filters. Considering a time domain characterization of the filter T, in one embodiment, one or both of the filters 1, 2 may each have a Q of about 0.7, and preferably less than 0.5, resulting in an over damped response which helps reduce the delay of the filter T. This is desirable since the path between the reference microphone 9 and the error microphone 8 (FIG. 2) is close to being non-causal and thus would not tolerate excess latency in generating the anti-noise signal sequence.

Figure 7:
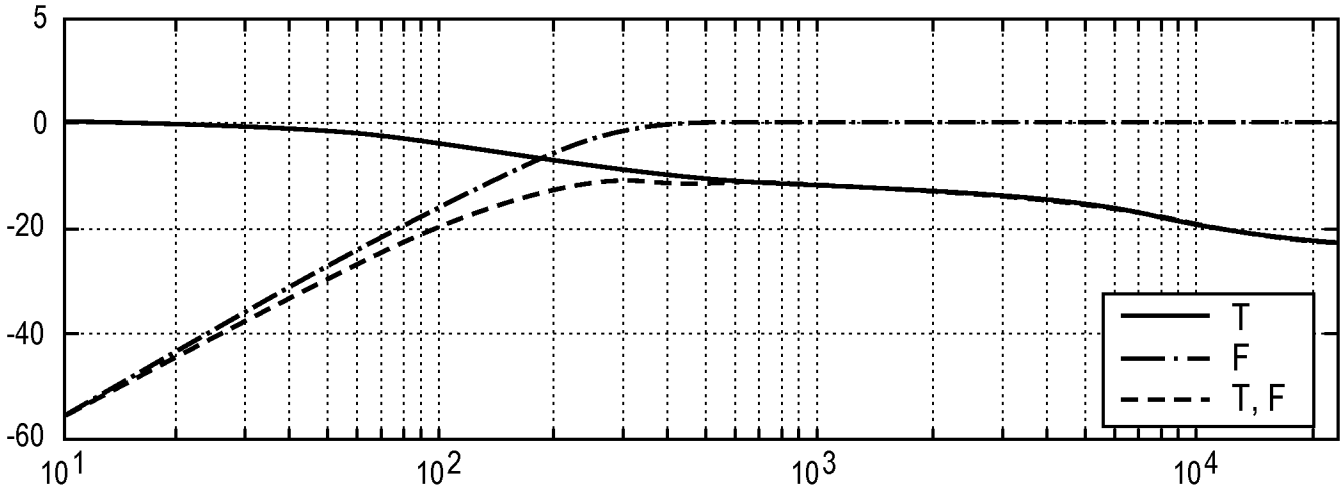
FIG. 7 shows the magnitude response of an example filter T, and its effect when combined with the estimated magnitude response F involving the response of the speaker.
Figure 8:
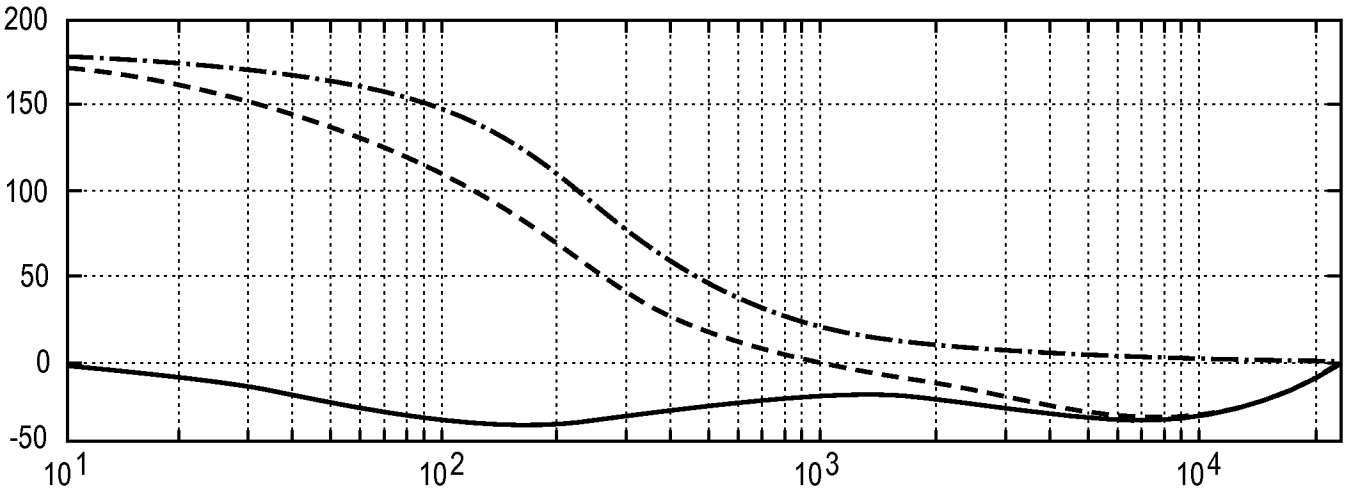
FIG. 8 shows the phase response of the example filter T in FIG. 7.

FIG. 7 shows the magnitude response of an example filter T, the estimated magnitude of the response F of the speaker 6, and their combination being a desired resulting response (for the ANC path between the ref mic 9 and the speaker 6, in the ANC system described above). The associated phase responses are given in FIG. 8. The F magnitude response may be a low frequency roll on or ramp, as shown in FIG. 7. An adaptive FIR filter, especially one with only 128 taps at a sampling frequency of 48 kHz, is not capable of modeling this kind of magnitude slope. Such an FIR filter by itself may not be able to produce the needed transfer function $F^{-1}$, i.e. the inverse of the frequency response F. However, the addition of filter T in front of the limited size adaptive FIR filter, may help the adaptive filter W produce the inverse of the needed transfer function T.F. FIG. 7 shows with T.F the rate of change of magnitude and phase is reduced at low frequency, compared with F alone, which reduces the load on the adaptive filter W.

The arrangement depicted in FIG. 2 may be implemented within an audio coder/decoder integrated circuit die, also referred to as a codec chip, that may perform several other audio related functions, such as analog-to-digital conversion, sampling, digital-to-analog conversion and pre-amplification of the microphone signals. In other embodiments, the arrangement of FIG. 2 may be implemented in a digital signal processing codec, which may include functions such as downlink and uplink speech enhancement processing (suitable for mobile two-way wireless communications) that may include mixing, acoustic echo cancellation, noise suppression, speech channel automatic gain control, companding, expansion, and equalization.

As explained above, an embodiment of the invention may be a machine-readable medium (such as microelectronic memory) having stored thereon instructions, which program one or more data processing components (generically referred to here as a "processor") to perform the digital audio processing operations described above including filtering, mixing, adding, inversion, comparisons, and decision making. In other embodiments, some of these operations might be performed by specific hardware components that contain hardwired logic (e.g., dedicated digital filter blocks). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, while the error microphone 8 may be located on the side or on the rear face of a smartphone housing, it could alternatively, be located within the housing of a wired or wireless headset which is connected to a local source of the audio signal such as a smartphone, a desktop computer, or a home entertainment system. The description is thus to be regarded as illustrative instead of limiting.

What is claimed is:

1. A portable personal listening audio device comprising:

an earpiece speaker having an input to receive an audio signal;

a reference microphone to pick up background acoustic noise outside of the device;

an error microphone to pick up sound emitted from the earpiece speaker; and active noise cancellation (ANC) circuitry having a pre-shaping digital filter whose input is coupled to the reference microphone and whose output is in series with, and in front of, an adaptive digital filter, the adaptive digital filter is to be adjusted by an adaptive filter controller based on input from a) the audio signal, b) the reference microphone and c) the error microphone, to provide an anti-noise signal to an input of the earpiece speaker to control the background acoustic noise that is heard by a user of the device, and wherein the pre-shaping digital filter is configured to be minimum phase and to present between at least 2 dB but no more than 15 dB more gain over a low audio frequency band than over a high audio frequency band.

2. The portable audio device of claim 1 further comprising a mobile phone handset housing in which the earpiece speaker is installed as a receiver, together with the reference microphone and the error microphone.

3. The portable audio device of claim 1 further comprising an earphone housing in which the earpiece speaker is integrated together with the error microphone and the reference microphone.

4. The portable audio device of claim 1 wherein the pre-shaping digital filter is to present more gain over the low frequency band being about 10 Hz-100 Hz than over the high frequency band being about 300 Hz-5 kHz.

5. The portable audio device of claim 4 wherein the phase response of the pre-shaping filter T over the 10 Hz-5 kHz band exhibits a phase change of less than ninety degrees.

6. The portable audio device of 4 wherein the phase response of the pre-shaping filter exhibits a phase change of less than 45 degrees over the 10 Hz-5 kHz band.

7. The portable audio device of claim 1 wherein the pre-shaping digital filter comprises a first $1^{st}$ order filter in series with a second $1^{st}$ order filter each of which is configured to be a minimum phase shelving filter.

8. The portable audio device of claim 1 wherein the pre-shaping digital filter comprises a first $1^{st}$ order filter in series with a second $1^{st}$ order filter, and wherein the first 1st order filter exhibits at least 2 dB more gain over a low frequency audio band than over a high frequency audio band, and the second $1^{st}$ order filter exhibits more gain over the high frequency band than over the low frequency band.

9. The portable audio device of claim 1 wherein the pre-shaping digital filter is a low pass filter having a Q of less than 0.5.

10. The portable audio device of claim 8 wherein the low frequency band is about 10 Hz-100 Hz, and the high frequency band is about 300 Hz-5 kHz.

11. The portable audio device of claim 1 wherein the adaptive digital filter is an adaptable FIR filter having between 1 and fs/f0 taps, where fs is the sampling frequency of an input signal to the adaptive digital filter and f0 is the lowest frequency of interest for ANC control.

12. The portable audio device of claim 1 wherein the pre-shaping filter is an IIR filter.

13. The portable audio device of claim 1 wherein the pre-shaping filter comprises first and second series connected programmable bi-quads that have been configured into said first and second $1^{st}$ order filters.

14. A method for active noise cancellation (ANC) in a portable personal listening audio device having an earpiece speaker, comprising:

pre-shaping a digital reference signal in accordance with a transfer function that is minimum phase and that presents a gain of at least 2 dB but no more than 15 dB over a low audio frequency band relative to a high audio frequency band;

producing an anti-noise signal using a primary path modeling adaptive filter of an ANC system, responsive to the pre-shaped digital reference signal; and adapting the primary path modeling adaptive filter responsive to a filtered version of the pre-shaped digital reference signal, wherein the filtered version is produced by a secondary path modeling adaptive filter of the ANC system.

15. The method of claim 14 wherein the transfer function presents more gain over the low frequency band being about 10 Hz-100 Hz than over the high frequency band being about 300 Hz-5 kHz.

16. The method of claim 14 wherein the transfer function has a phase response over the 10 Hz-5 kHz band that exhibits a phase change of less than ninety degrees.

17. The method of claim 16 wherein the phase response exhibits a phase change of less than 45 degrees over the 10 Hz-5 kHz band.

18. The method of claim 14 wherein the low frequency band is about 10 Hz-100 Hz, and the high frequency band is about 300 Hz-5 kHz.

19. A portable personal listening audio device comprising:

means for producing anti-noise sound in accordance with an anti-noise signal;

means for picking up background acoustic noise as a digital reference signal;

means for pre-shaping the digital reference signal; and digital adaptive filter means for producing the anti-noise signal using the pre-shaped digital reference signal, wherein the pre-shaping means comprises a low shelf filter that provides increased gain of at least 2 dB but no more than 10 dB in a low audio frequency band relative to a high audio frequency band.

20. The audio device of claim 19 wherein the pre-shaping means has a transfer function that presents more gain over the low frequency band being about 10 Hz-100 Hz than over the high frequency band being about 300 Hz-5 kHz.

21. The audio device of claim 20 wherein the transfer function has a phase response over the 10 Hz-5 kHz band that exhibits a phase change of less than ninety degrees.

22. The audio device of claim 19 wherein the low frequency band is about 10 Hz-100 Hz, and the high frequency band is about 300 Hz-5 kHz.

* * * * *